US005441455A

United States Patent [19]

Carruthers

[11] Patent Number: 5,441,455

[45] Date of Patent: Aug. 15, 1995

[54] TABLE GAME HAVING A CURVED PLAYING SURFACE

[76] Inventor: William J. Carruthers, 16 Chambers Rd., Dundee, N.Y. 14837

[21] Appl. No.: 352,694

[22] Filed: Dec. 1, 1994

[51] Int. Cl.[6] ..... A63D 15/02; A63F 7/00

[52] U.S. Cl. ..... 473/20; 273/108; 273/118 R

[58] Field of Search ..... 273/118 R, 108, 119 R, 273/121 R, 123 R, 129 R, 125 R, DIG. 31, 85 R; 473/4, 20–29

[56] References Cited

U.S. PATENT DOCUMENTS

| | | | |
|---|---|---|---|
| 160,234 | 2/1875 | Riedinger | 273/108 |
| 160,820 | 3/1875 | Gill | 273/108 |
| D. 248,250 | 6/1978 | Langieri | D34/5 JJ |
| D. 265,415 | 7/1982 | Bighaus | D21/232 |
| 3,466,042 | 9/1969 | Lucci | 273/85 |
| 4,004,807 | 1/1977 | Leonhart | 273/41 |
| 4,585,235 | 4/1986 | Williams | 273/355 |
| 5,207,790 | 5/1993 | Eveillard | 473/29 |

FOREIGN PATENT DOCUMENTS

| | | | |
|---|---|---|---|
| 636378 | 4/1928 | France | 273/118 R |
| 63402 | 7/1892 | Germany | 473/28 |
| 617008 | 7/1935 | Germany | 273/118 R |

*Primary Examiner*—Benjamin H. Layno

[57] ABSTRACT

A game table having a curved playing surface is disclosed. Openings for balls and pegs are arranged in rows on the curved playing surface.

12 Claims, 2 Drawing Sheets

Fig. 2
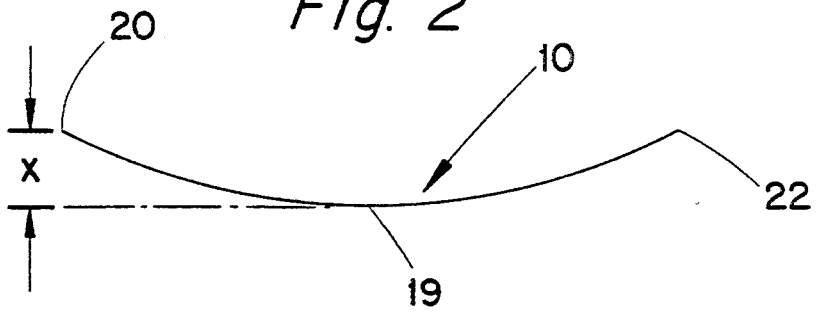
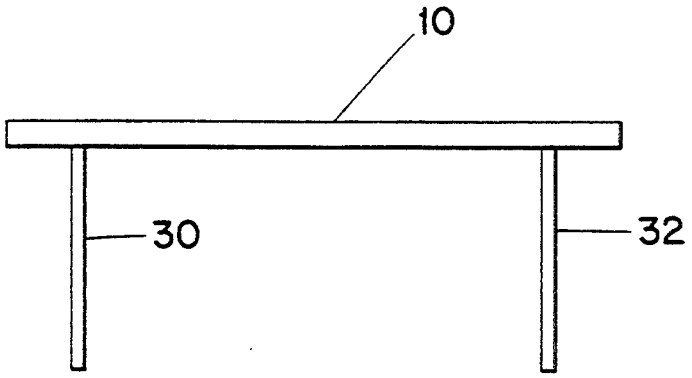
Fig. 3

TABLE GAME HAVING A CURVED PLAYING SURFACE

BACKGROUND

The present invention generally relates to games and, more particularly, to a new type of table game.

Table games have been popular worldwide for at least several centuries. Even those who are not fond of such games will recognize the widespread popularity of games such as billiards, in which small balls are placed on an oblong table and driven against one another or into pockets. Table tennis is also very popular, a racket sport in which a ping pong ball is struck by opponents on opposite sides of the table over an intervening net.

While these traditional favorites are still quite popular and likely will never lose their following, new table games periodically arise. For example, air hockey became popular in the mid- 1970's. In this table game, forced air is distributed through many tiny holes on the table's surface. The forced air reduces the friction of a puck relative to the table's surface, enabling the puck to glide thereover so that opponents can send the puck from one end of the table to the other at high speeds.

Despite the appeal of these conventional table games, there is a continuing need to supply new and different table games for public entertainment. The continuing popularity of the aforedescribed older table games, and the ready market for newer games, such as air hockey, demonstrate this need.

SUMMARY

Applicant's invention satisfies this need and provides a new table game including a new type of game playing table. According to exemplary embodiments of the present invention, this game playing table includes a curved surface which creates exciting and slightly unpredictable play when compared with many conventional table games which are played on level playing surfaces. The curved playing surface includes smaller openings for inserting pegs therein and larger depressions which releasably accommodate balls.

BRIEF DESCRIPTION OF THE DRAWINGS

The foregoing objects, features and advantages of the present invention will be more readily understood upon reading the following detailed description in conjunction with the drawings in which:

FIG. 2 is an end view of the table of FIG. 1 illustrating the curvature of the playing surface according to an exemplary embodiment of the presen invention; and FIG. 3 is a side view of the table of FIG. 1.

DETAILED DESCRIPTION

Figure 1:
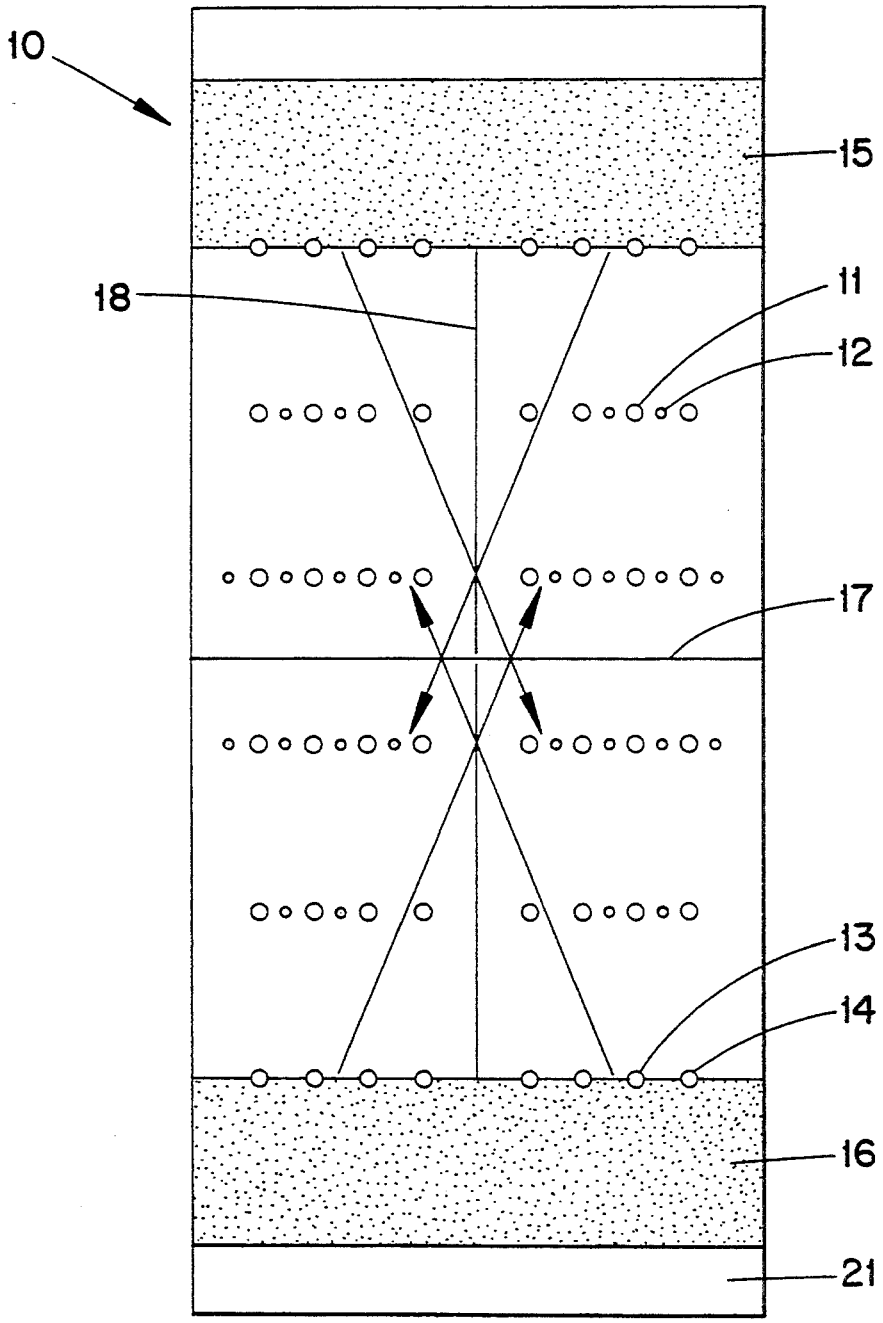
FIG. 1 is a top view of an exemplary game playing table according to an exemplary embodiment of ! the present invention.

FIG. 1 illustrates an exemplary embodiment of a game playing table according to the present invention from a top view wherein the curvature of the table is not readily apparent. However, this view is advantageous for describing the table layout.

The exemplary table 10 includes a plurality of rows of openings 11 and 12 disposed across the surface, of the table. In the exemplary embodiment of FIG. 1, six rows are illustrated, although those skilled in the art will readily appreciate that more or fewer could be provided. According to this exemplary embodiment, the openings 11 are adapted to releasably receive balls, e.g., 13 and 14, while openings 12 are adapted to receive pegs. Note that FIG. 1 depicts eight balls per side all of which are resting on the two rows furthest from the center of the table (shown by the blackened circles as opposed to the untilled circles). The openings 11 are depicted in FIG. 1 as being somewhat larger than the openings 12, however the size of the openings 11 and 12 is dependent upon the diameters of the balls and pegs, respectively, which can be of any desired size.

An object of exemplary games which can be played using table 10 is to dislodge an opponent's balls from the openings 11 in which they are resting. The pegs (not shown in FIG. 1) which can be inserted into various of the openings 12 serve as impediments to the striking or cue ball (not shown in FIG. 1 ) as described below.

As can be seen in FIG. 1, the table 10 can be divided into a plurality of regions. In the exemplary embodiment of FIG. 1, these regions are designated as follows. Regions 15 and 16 are release regions within which a player's striking or cue ball is to be rollingly released upon the surface of the table 10 Abutting these regions are the operating game regions which are separated by the centerline 17. The game operating regions hold the balls and pegs and generally define the "in play" region of the table. Centerline 18 divides the table in half lengthwise. Note that the openings 11 and 12 on opposite sides of centerline 18 generally mirror one another (with the exception that the rows next to the centerline 17 contain uneven numbers of openings 12).

An interesting feature of the table 10 is illustrated by the arrows in FIG. 1. These arrows describe "corner-to-corner" play, but also highlight that the second and third rows of openings 11 and 12 only have four openings 12 apiece whereas the first rows, i.e., those closest to centerline 17 have seven openings 12 apiece. This promotes an area of openness on the table 10 for launching one's striking or cue ball.

As described above, another interesting feature of the present invention is that the table 10 is a curved surface. This feature will be more readily appreciated upon viewing FIG. 2 which shows an end view of table 10. Therein note that the center portion 19 is lower than the outer portion or edges 20 and 22 by some predetermined distance x. For example, x can be about 2 inches for a four foot wide table 10. However, those skilled in the art will appreciate that the distance x can be adjusted to provide different curvatures and correspondingly different table; layouts. Moreover, this curvature could be varied mechanically by placing; a movable support under the centerline 18 of table 10.

Although the curvature is described above such that the edges 20 and 22 are an equal height from center portion 19, one edge 20 or 22 could be higher than the other relative to the center portion 19. This curvature feature of the present invention causes the striking or cue ball to travel a circuitous route on the table 10 which makes judging the necessary speed and path to strike an opponent's balls resting in openings 11 without hitting pegs in openings 12 a challenging task. Pocket 21 is a convenient holding area for balls which are out of play.

FIG. 3 illustrates that. exemplary embodiments of table 10 can be supported by legs 30 and 32 so that the entire unit is disposed at a comfortable height for standing players. Alternately, table 10 can be constructed for overlay on existing tables, much like, for example, table tennis platforms have been designed for support by pool tables.

The table 10 can be made from any type of material, for example, plywood, plastic, fiberglass, metal, etc. The balls, e.g., 13 and 14, can be ceramic and of approximately the size of pool balls, although the particular size and material from which these: balls are made can certainly be varied. The pegs (not shown) which can be fitted into openings 12 can be made from wood, plastic, metal, or any other commericially available material.

While the present invention has been described using the foregoing exemplary embodiments, these; embodiments are intended to be illustrative in all respects, rather than restrictive of the present invention. Thus, the scope of the present invention is instead set forth by the appended claims and encompasses any and all equivalents and modifications embraced thereby.

What is claimed is:

1. A table comprising:

a surface having a plurality of first and second openings thereon, said first and second openings adapted to receive pegs and balls, respectively;

wherein said plurality of first and second openings are arranged in rows across said surface; and wherein said surface is curved from an outer edge thereof down toward a center.

2. A game surface comprising:

a plurality of openings arranged in rows thereon; and wherein said surface has a curvature such that a center portion of said surface is lower than an outer perimeter of said surface.

3. The game surface of claim 2, wherein said openings comprise first and second openings of different sizes.

4. The game surface of claim 3, wherein said first openings are smaller than said second openings.

5. The game surface of claim 4, wherein said first openings are separated from one another within said rows by at least one of said second openings.

6. The game surface of claim 2, wherein there are six rows of said plurality of openings.

7. The game surface of claim 6, wherein said six rows include two sets of three rows each, each set being mirrored on opposite sides of a centerline of said game surface.

8. The game surface of claim 7, wherein each of said sets of rows include:

a first row, closest to said centerline, including eight first openings and seven second openings, said first openings being larger than said second openings;

a second row, in between said first row and a third row, including eight first openings and four second openings; and a third row, including eight first openings and four second openings.

9. A game surface comprising:

means for displacingly seating a plurality of balls;

means for receiving a plurality of pegs; and wherein said game surface is curved such that a center portion of said surface is lower than an outer portion of said surface.

10. The game surface of claim 9, wherein said means for displacingly seating a plurality of balls comprises a plurality of first openings.

11. The game surface of claim 9, wherein said means for receiving a plurality of pegs comprises a plurality of second openings.

12. The game surface of claim 9, wherein said center portion is approximately two inches lower than said outer portion of said surface.

* * * * *